United States Patent [19]

Semmler et al.

[11] 3,941,055

[45] Mar. 2, 1976

[54] CARRIER FOR FLEXIBLE PRINTING PLATES

[75] Inventors: Eduard O. Semmler; Klaus Güthling; Adolf J. G. Meyer, all of Luneburg, Germany

[73] Assignee: Wilhelm Barenschee, Luneburg, Germany

[22] Filed: Oct. 18, 1974

[21] Appl. No.: 515,854

Related U.S. Application Data

[63] Continuation of Ser. No. 331,107, Feb. 9, 1973, abandoned.

[30] Foreign Application Priority Data

Feb. 16, 1972 Germany ..... 2207138

[52] U.S. Cl. ..... 101/415.1; 101/378

[51] Int. Cl.[2] ..... B41F 27/06; B41F 27/12

[58] Field of Search ..... 101/415.1, 378; 248/323

[56] References Cited

UNITED STATES PATENTS

| | | | |
|---|---|---|---|
| 1,651,924 | 12/1927 | Lichtenstein | 101/415.1 |
| 2,137,851 | 11/1938 | Nelson et al. | 101/415.1 |
| 2,627,230 | 2/1953 | Huck et al. | 101/415.1 |
| 2,706,947 | 4/1955 | Albrecht | 101/415.1 |
| 2,767,653 | 10/1956 | Babicz | 101/409 |
| 3,332,346 | 7/1967 | Luehrs | 101/415.1 |
| 3,416,447 | 12/1968 | Pozniak | 101/415.1 |
| 3,533,355 | 10/1970 | Wall | 101/415.1 |
| 3,669,398 | 6/1972 | Robinson | 248/373 |
| 3,766,857 | 10/1973 | Schlatter | 101/415.1 |

*Primary Examiner*—Edgar S. Burr
*Assistant Examiner*—Paul J. Hirsch
*Attorney, Agent, or Firm*—Stevens, Davis, Miller & Mosher

[57] ABSTRACT

A flexible printing plate carrier comprises a curved carrier plate at least one end of which has mounted thereon a rotatable tubular shaft having an axially extending projection about which a bent over end of the printing plate can be hooked. A pre-loaded torsion spring extends through the tubular shaft to urge the projection towards an edge of the carrier plate and to clamp the printing plate against said edge. Rotation of the shaft to the non-clamping position of the projection is effected by a hand tool insertable into a bearing for one end of the shaft.

11 Claims, 15 Drawing Figures

CARRIER FOR FLEXIBLE PRINTING PLATES

This is a continuation of application Ser. No. 331,107, filed Feb. 9, 1973, now abandoned.

BACKGROUND OF THE INVENTION

1. Field of the Invention

This invention relates to a carrier for a flexible printing plate and which comprises a curved carrier plate arranged to be attached to a cylinder, such as a forme cylinder or the like, and a clamping device disposed at at least one end of the carrier plate.

2. Description of the Prior Art

In a carrier of the above mentioned kind the clamping device usually has a plurality of clamping elements which have to be operated individually. It is, for example, known (German Utility Model No. 1,884,632) to provide, at at least one end of the carrier plate, a clamping bar on which an end of a flexible printing plate can be held and which is adapted to be moved away from the end of the carrier plate by means of a clamping device, the latter having a number of clamping elements, in the form of screws, which are spaced apart from one another along the clamping bar and which can be screwed through threaded holes formed in the clamping bar, their ends being supported on the end face of the carrier plate. When a carrier of this kind is used, clamping of a printing plate to the carrier takes up a relatively considerable period of time. Furthermore, it must always be ensured that the clamping bar is clamped exactly parallel to the axis of the carrier plate, so that the printing plate is not tilted.

There is thus a need for a clamping device which is of comparatively simple construction and can be operated rapidly, simply, and reliably.

SUMMARY

According to the invention there is provided a carrier for a flexible printing plate comprising a curved carrier plate arranged to be attached to a cylinder, and at at least one end of the carrier plate a clamping device carried by the carrier plate, said device being movable relative to the carrier plate into and out of a position of rest in which it is arranged to hold an end of a flexible printing plate clamped against the carrier plate, and spring means operable to urge the clamping device towards and to retain the device in said position of rest thereof. This clamping device preferably includes a projection which extends over the width of the carrier plate and extends lengthwise of a tubular shaft rotatably mounted on the carrier plate. The spring means preferably comprises a torsion spring which extends through the tubular shaft and has one end thereof non-rotatably fastened to a holder mounted in a fixed position on the carrier plate and the other end non-rotatably mounted on the tubular shaft.

In order to clamp a printing plate to a carrier according to the invention, it is sufficient to turn the tubular shaft in the release direction by means of a suitable turning device, against the force of the spring means, to hook a folded-over or bent-over end of the printing plate behind the clamping device, and then to release the turning device, whereupon the clamping device is automatically turned into the clamping position by the force of the spring means. The clamped position is so selected that the clamping device is located inside the imaginary cylinder formed by the outer curved surface of the carrier plate.

DESCRIPTION OF PREFERRED EMBODIMENTS

Figure 1:
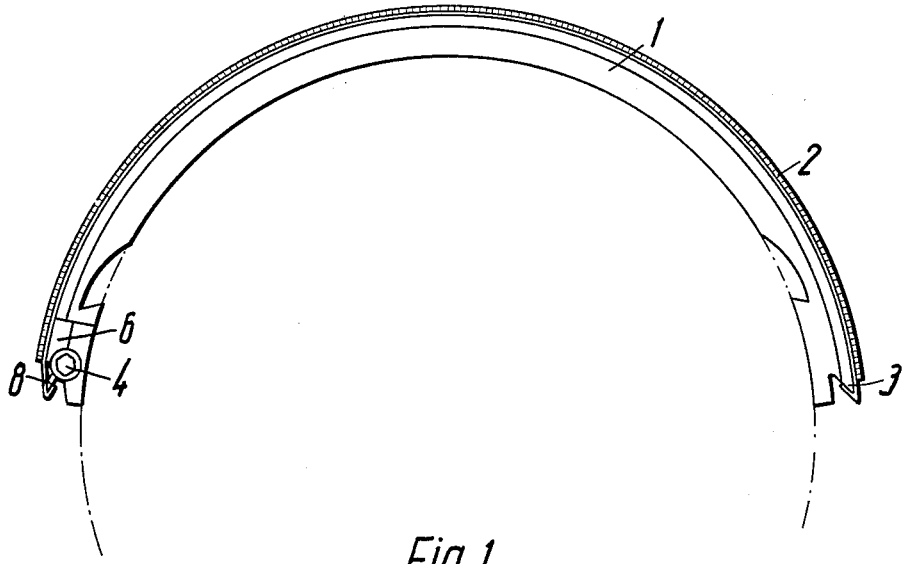
FIG. 1 is a diagrammatic side view of one embodiment of clamping device according to the invention.

Referring to the drawings FIG. 1 shows a curved carrier plate 1, which may be a printing block carrier or a printing plate carrier.

In the embodiment illustrated the plate 1 comprises a saddle plate which on its inner surface is provided with recesses for clamping on a cylinder, as is known per se.

At the right-hand end (in FIG. 1) the saddle plate is provided with an inclined surface 3 behind which the end of a flexible printing plate 2 is hooked, the said end being bent over at an acute angle, for example at an angle of 30°. At the other end, that is to say at the left-hand end of the saddle plate 1 in FIG. 1, there is provided a clamping device by means of which the corresponding end of the flexible printing plate 2 is fastened on the saddle plate 1.

Figure 2:
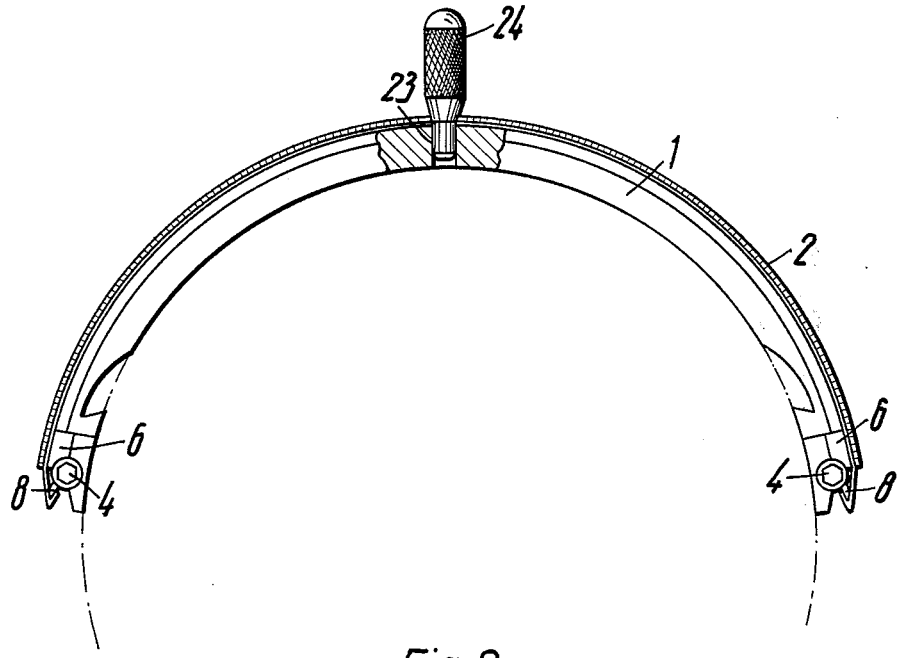
FIG. 2 is a similar view to FIG. 1 of a modified embodiment of the invention.

The embodiment illustrated in FIG. 2 differs from that shown in FIG. 1 solely in that clamping devices are provided at both ends of the saddle plate 1, and that in the middle of the saddle plate there are formed register holes 23 into which register pins 24 can be inserted.

Figure 7:
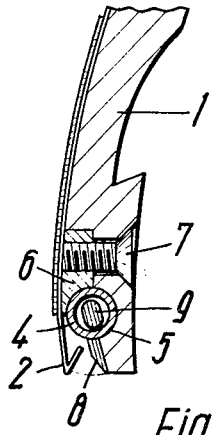
Figure 8:
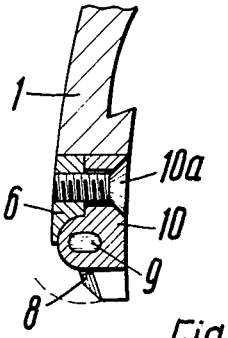
Figure 9:
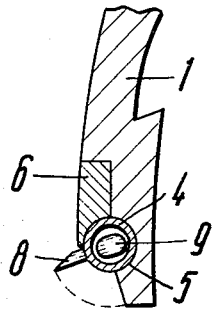
Figure 10:
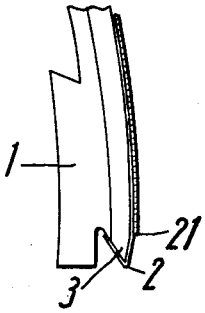

The clamping device according to the invention will now be explained with reference to the drawing. As illustrated, each clamping device includes a tubular shaft 4 which is mounted rotatably at the respective end of the carrier plate or saddle 1. For the rotatable mounting of the tubular shaft 4, two or more individual bearings may be formed on the carrier plate 1. A preferred bearing is shown in the drawing, and it comprises a recess 5, FIGS. 7 and 9, which extends over the width of the carrier plate 1 and embraces the tubular shaft 4 over an arc of more than 180°, so that once the tubular shaft is located in its recess 5 it cannot be moved out of the recess. The recess 5 is formed by a surface formed in the end of the carrier plate 1 and by a surface provided in a bar 6 which is suitably fastened on the carrier plate 1, for example by means of screws 7, illustrated in FIG. 3, and which extends over the width of the carrier plate 1. The mutually opposite free edges of the carrier plate 1 and of the bar 6 are so shaped that an approximately segmental gap is formed between them in which a projection 8 formed on the tubular shaft 4 and extending over the length of the shaft 4 can move on the rotation of the tubular shaft 4. The bounding surfaces of the gap serve as limits for the movement of the projection 8 and consequently of the rotary movement of the tubular shaft 4. The boundary surface formed at the end of the carrier plate 1 extends obliquely inwards in such a manner that when the projection 8 lies against it, as shown in FIGS. 7 and 8, the projection 8 lies within an imaginary cylinder described by the curved outer surface of the carrier plate 1. This position of the projection 8 is referred to as the position of rest.

Figure 4:
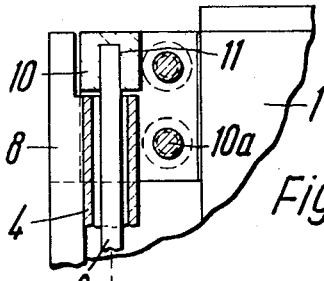
FIG. 4 is a partly sectional view to an enlarged scale of one end of a clamping device of FIG. 3.
Figure 3:
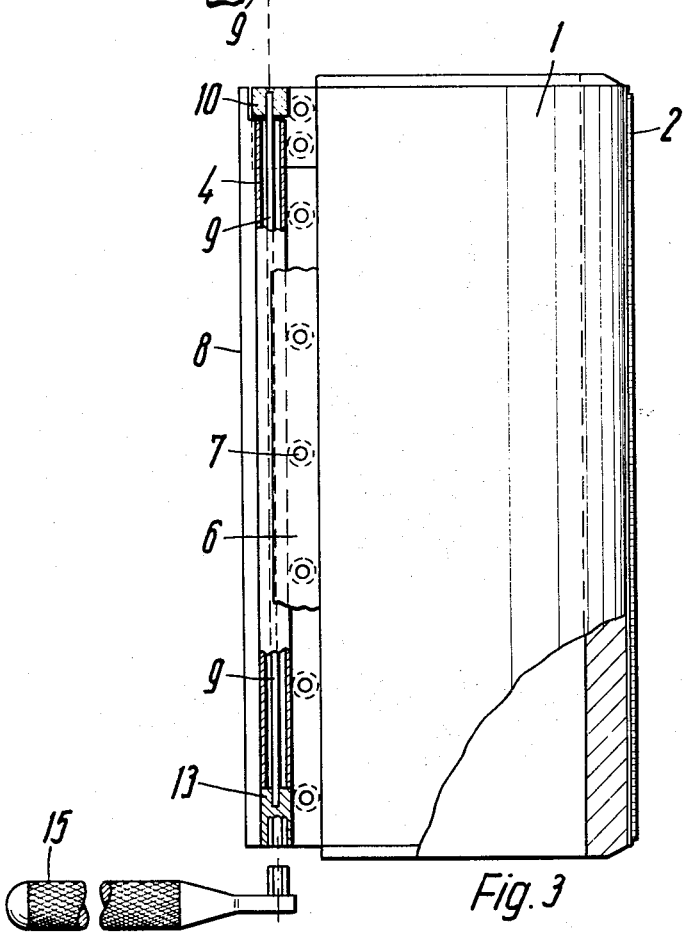
FIG. 3 is a partly sectional view of the embodiment shown in FIG. 1.
Figure 3A:
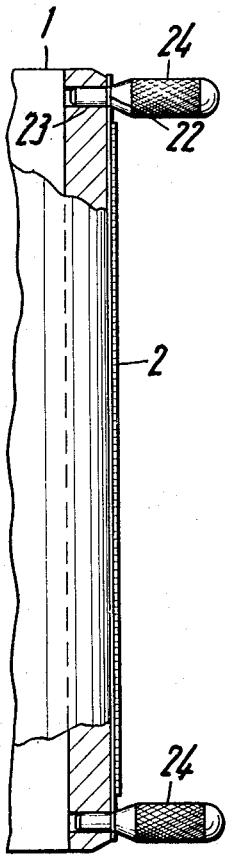
FIG. 3*a* is a partly sectional partial side view of the embodiment shown in FIG. 2.

The tubular shaft 4 is spring-loaded in the direction of the clamping position of the projection 8. In the embodiment illustrated a bar-like torsion spring 9 is provided in the tubular shaft 4. The torsion bar 9 is preferably a flat bar, as illustrated in the drawing. The arrangement of the torsion bar 9 can be seen particularly well in FIGS. 3 to 5. FIG. 3 shows the general arrangement, while in FIGS. 4 and 5 the holders for the ends of the torsion bar 9 on the carrier plate 1 are shown. According to FIG. 4 a bearing element 10 is provided, which is fastened, for example by means of screws 10*a*, on the bar 6. The bearing element 10 is provided with a recess 11 which has a cross-section corresponding to that of the torsion bar 9, so that the respective end of the torsion bar 9 is received non-rotatably in the recess 11.

Figure 5:
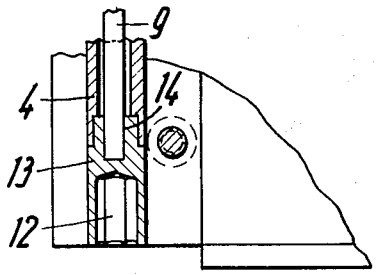
FIG. 5 is a view, similar to FIG. 4, of the other end of the clamping device.

The opposite end of the torsion bar 9 is held in a bearing element 13, FIG. 5, which has a recess 14 which likewise has a cross-section corresponding to that of the torsion bar 9, so that at this end also the torsion bar is fastened non-rotatably. The bearing element 13 is in turn secured to the neighbouring end of the tubular shaft 4, so that it rotates with the shaft. At the outer end of the bearing element 13 there is provided an aperture 12 for the insertion of a rotating tool 15 (see FIG. 3). With the aid of the rotating tool 15 it is possible, by using a single tool, to turn the tubular shaft 4 and consequently the projection 8 inside the segmental gap bounded by the corresponding surfaces of the carrier plate 1 and bar 6.

The torsion bar 9 is held in such a manner that when the tubular shaft 4 and consequently the projection 8 are in the installed position the desired initial stressing in the direction of the position of rest of the projection 8 is provided. This means that when the tubular shaft 4 is in the installed position and the projection 8 lies against the inclined surface at the end of the carrier plate, that is to say when the projection is in the position of rest, the recesses 11 and 14 holding two ends of the torsion bar 9 are angularly offset in relation to one another in such a manner that the torsion bar 9 is twisted so that the clamping projection 8 is pressed against the previously mentioned inclined surface on the end of the carrier plate by the spring force of the torsion bar 9. The extent to which the two recesses 11 and 14 are angularly offset in relation to one another depends on the construction of the torsion bar, the desired initial stressing and so on.

The torsion bar need not necessarily have the cross-sectional shape of a flat bar as illustrated in the drawing. It may for example be a simple bar of circular cross-section, which is simply so shaped at its ends that it can be held non-rotatably. The torsion bar may, however, instead be a polygonal bar or a tube, according as to whether circumstances require any particular shape to be preferred for the bar.

Figure 6:
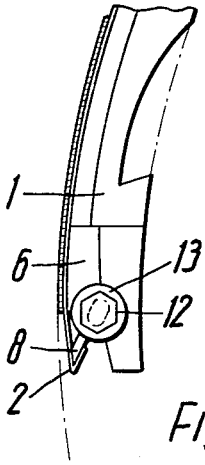
FIGS. 6 to 11 are partial views, partly in section, illustrating details of construction and the mode of operation of the clamping device.

For the purpose of clamping a flexible printing plate 2, for example on a saddle plate 1 according to FIG. 1, the bent-over or folded-over end of the printing plate is hooked behind the inclined surface 3 on the right-hand end (in FIG. 1) of the carrier plate 1. By means of the turning tool 15 the tubular shaft 4 at the other end, that is to say at the left-hand end of the carrier plate 1 in FIG. 1, is thereupon turned in the clockwise direction until the clamping projection 8 assumes approximately the position shown in FIG. 9. In this position the neighbouring end of the printing plate 2, which is likewise folded over or bent over, can be hooked behind the clamping projection 8. On the release of the turning tool 15 the tubular shaft 4 together with the clamping projection 8 then turns in the counter-clockwise direction (in FIG. 1) through the action of the torsion spring 9, so that the clamping projection 8 reaches the position shown in FIGS. 1, 2, and 6.

Figure 12:
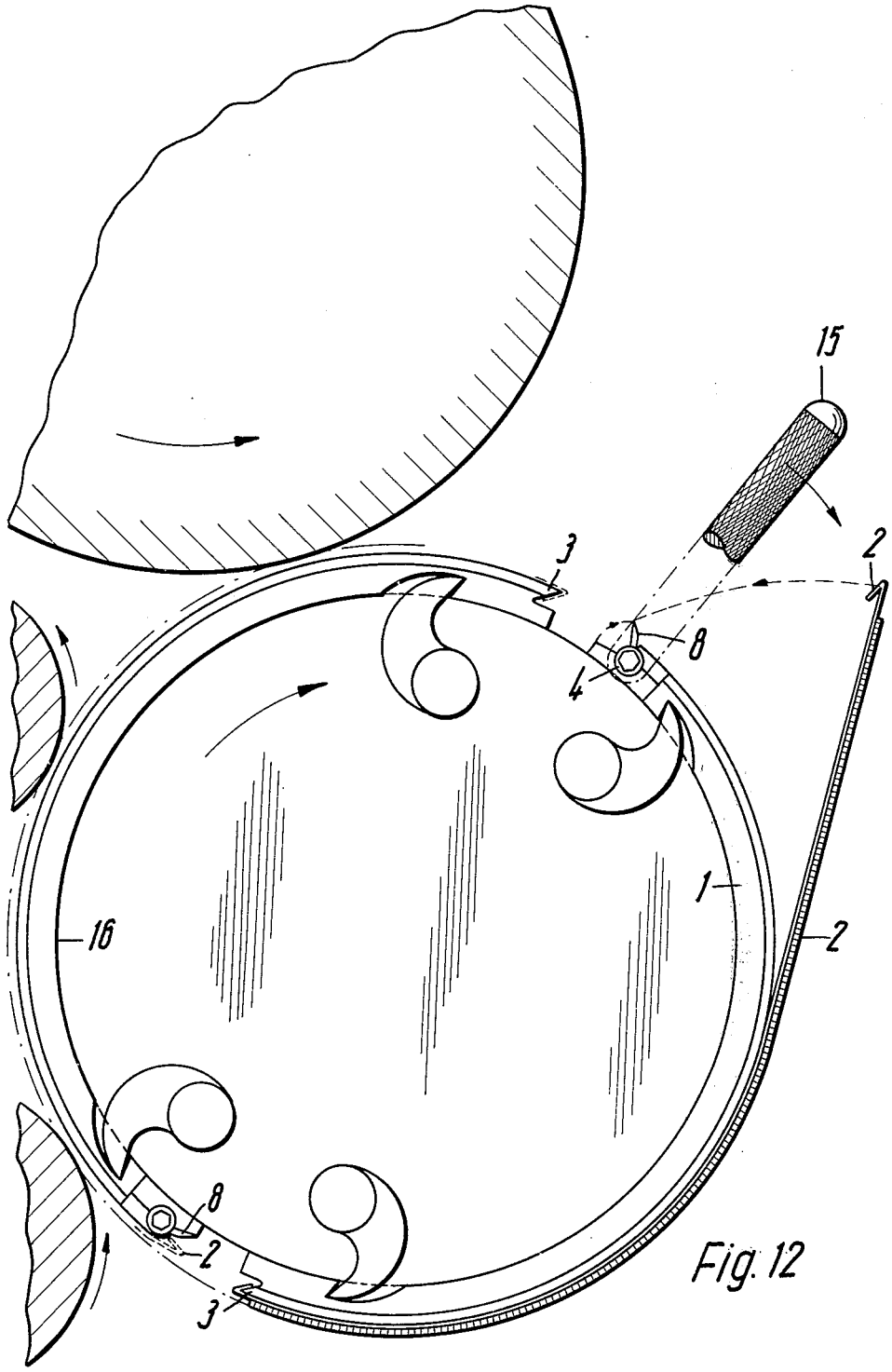
FIG. 12 is a diagrammatic side view, partly broken away, of a printing mechanism in which there is provided a cylinder on which are mounted carrier plates provided with clamping devices according to the invention.

It should be observed that because of the segmental gap formed between the bar 6 and the neighbouring end of the carrier plate, sufficient room is provided to enable the end of the printing plate, even when it is not hooked about the clamping projection 8, to assume a position in which it at least does not lie outside the periphery of the carrier plate 1 or of the cylinder described by the outer surface of the carrier plate 1. In this way it is made possible for the printing plates 2 on the carrier plates 1 to be conveniently changed without it being necessary for the carrier plate 1 to be detached from the appertaining plate cylinder for this purpose, because even the unclamped end of a printing plate 2 can still lie within the cylinder described by the outer surface of the curved carrier plate 1, as illustrated in FIGS. 7 and 12.

The mode of operation for clamping when the embodiment illustrated in FIG. 2 is used is similar to that in the case of the embodiment shown in FIG. 1, with the exception that register pins 24 are first inserted, whereupon each end of the printing plate is clamped in position in the manner previously described.

Figure 11:
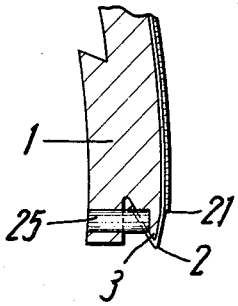
Figure 13:
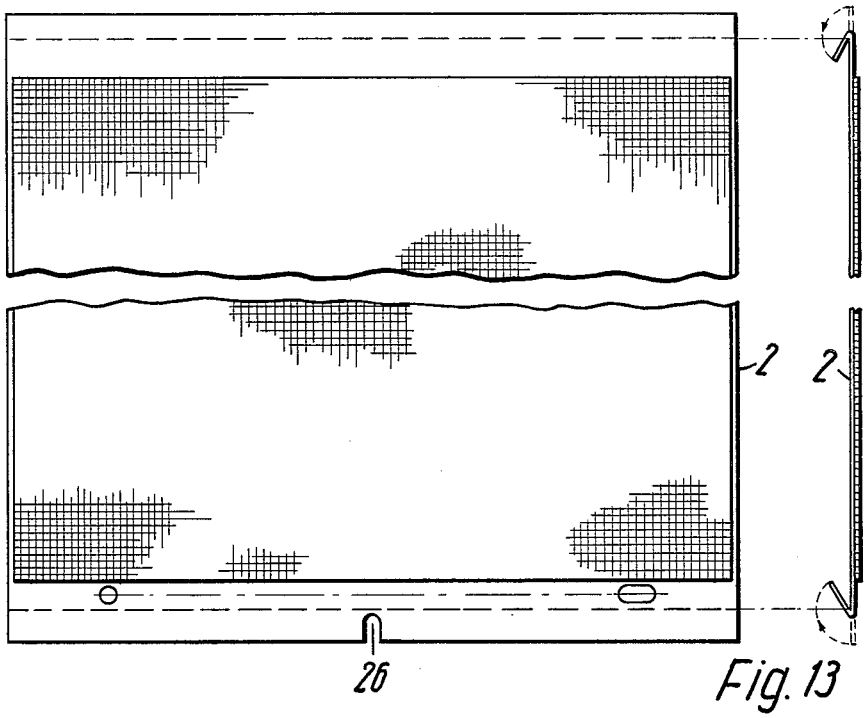
FIGS. 13 and 14 are diagrammatic representations of a printing plate.
Figure 14:
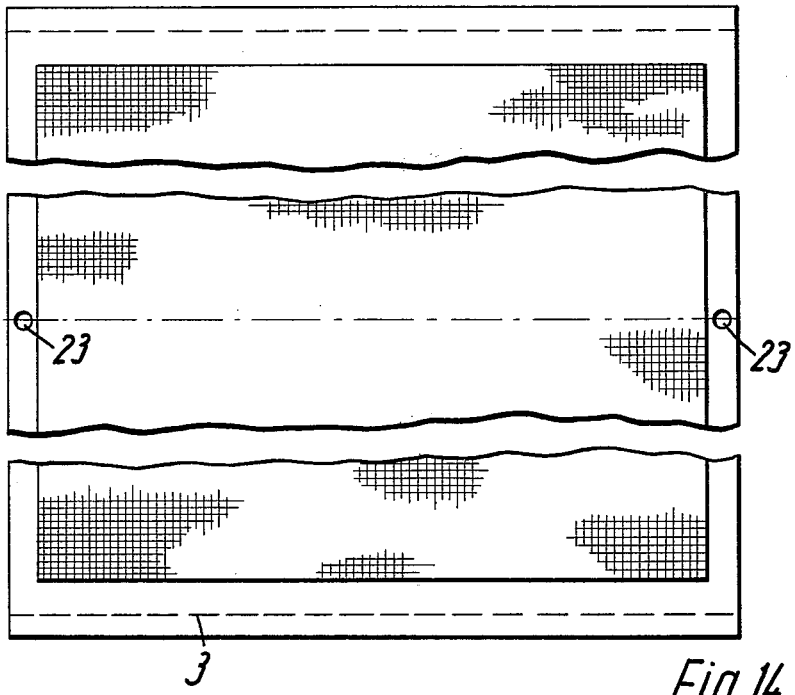

In the embodiment illustrated in FIG. 1 provision may be made for lateral fastening of the printing plate 2 on the carrier plate 1 at the right-hand end of the carrier plate 1 (referring to the Figure) and approximately in its centre a register aperture may be provided which can be made to coincide with a corresponding register aperture 26 (FIG. 13) in the end of the printing plate, whereupon a register pin 25 is inserted, as illustrated in FIG. 11.

We claim:

1. A device for clamping flexible printing plates having a bent-over end on a curved saddle plate to be attached to a plate cylinder or the like, wherein clamping means is provided at at least one end of said saddle plate and is of a thickness less than that of said saddle plate, said clamping means comprising a clamping element adapted for engagement with the bent-over end of the printing plate and spring loaded in the clamping direction, said clamping element having a projection or nose extending over the entire width of the saddle plate, the bent-over end of the printing plate being adapted to be hooked behind said projection which is provided on torsion spring means attached to the saddle plate, said torsion spring means comprising a rotatable tubular shaft in which a torsion spring is disposed, said torsion spring having one end thereof non-rotatably fastened to a holder mounted in a fixed position on the saddle plate and the other end non-rotatably mounted on the tubular shaft and said torsion spring being installed under initial stressing in accordance with the spring loading to be imparted to the projection.

2. The device according to claim 1, wherein the end of the torsion spring mounted on the shaft is held by a bearing element secured to the tubular shaft and the bearing element is provided with at least one hole for the insertion therein of a shaft-turning tool.

3. The device according to claim 2, wherein a polygonal aperture extending axially of the tubular shaft is provided for the turning tool.

4. The device according to claim 1, wherein the nose is so formed as to permit the hooking thereabout of an end of a flexible printing plate bent over at an acute angle of about 30°.

5. The device according to claim 1, wherein the tubular shaft is mounted at two or more points on the saddle plate.

6. The device according to claim 1, wherein the tubular shaft is mounted on the saddle plate over substantially the whole width of the carrier plate in a recess arranged to embrace the shaft peripherally to an extent of more than 180°, said recess being formed in part by an arcuate surface in the saddle plate and in part by a curved surface on a recess-forming bar which extends over the width of the saddle plate and is secured to the saddle plate.

7. The device according to claim 1, in which the torsion spring is a non-circular bar.

8. The device according to claim 1, in which the torsion spring is a flat bar.

9. The device according to claim 1, in which the torsion spring is a bar of circular cross-section with non-circular ends.

10. The device according to claim 1, in which the torsion spring is a tube which is non-rotatably clamped at its ends.

11. The device according to claim 6, wherein the arcuate portions of the saddle plate and of the recess-forming bar form between them a gap permitting the movements of the projection and lying within a cylinder of which the outer curved surface of the saddle plate is a part.

* * * * *